United States Patent [19]

Wood

[11] 4,120,267

[45] Oct. 17, 1978

[54] TUBE AND PLATE HEAT EXCHANGER

[76] Inventor: Michael J. Wood, 9431 Lotus Dr., Westminster, Calif. 92683

[21] Appl. No.: 761,331

[22] Filed: Jan. 21, 1977

[51] Int. Cl.[2] ..... F22D 1/08; F28F 1/30

[52] U.S. Cl. ..... 122/20 B; 122/367 C; 122/421; 165/182

[58] Field of Search ..... 122/20 A, 20 B, 367 C, 122/412, 420, 421; 165/181, 182

[56] References Cited

U.S. PATENT DOCUMENTS

| | | | |
|---|---|---|---|
| 780,565 | 1/1905 | Humphrey | 122/367 |
| 886,516 | 5/1908 | Kablitz | 122/421 |
| 1,591,097 | 7/1926 | Monsen | 122/20 |
| 1,839,461 | 1/1932 | Beman | 122/20 |
| 2,006,726 | 7/1935 | Walsh | 122/20 |
| 2,475,187 | 7/1949 | Kramer | 165/182 |
| 3,889,642 | 6/1975 | Fung | 122/367 |
| 3,916,989 | 11/1975 | Harada et al. | 165/181 |
| 3,991,821 | 11/1976 | Cook et al. | 122/20 |

*Primary Examiner*—Kenneth W. Sprague
*Attorney, Agent, or Firm*—George F. Bethel; Patience K. Bethel

[57] ABSTRACT

The invention as disclosed in the following specification, relates to a heat exchanger, having tubes fitted into plates, that exchange heat from a gas passing thereover to fluids passing through the tubes. The heat exchanger is particularly adaptable to boilers having fire tubes and other types of boilers wherein the heat applied to the tubes is circulated and then exhausted. Prior to exhaust, the heated gas is passed over the plates in a duct. The tubes in the plates are used to pick up the heat from the exhaust gases by means of the feed water passing through the tubes, or the tubes can be used to directly heat other fluids, such as oil and service hot water. A damper is placed over the normal exhaust gas flue in conjunction with a second damper or duct control system whereby an exhaust fan on the downstream side of the heat exchanger duct provides a constant draw to allow the boiler to operate within its normal pressure ranges. An optimum exchange relationship between the tubes and the plates effectuates the proper heat transfer for the respective flow rates and temperature involved by means of employing a specially configured tube pitch within the plates. The exchanger is controlled by a series of electrical controls for providing adequate exhaust damping and flow rates.

12 Claims, 8 Drawing Figures

TUBE AND PLATE HEAT EXCHANGER

BACKGROUND OF THE INVENTION

1. Field of the Invention

The field of this invention lies within the heat exchanger art. It includes the field of boiler economizers or recovery units that are utilized with boilers, to save energy from exhaust gases.

2. The Prior Art

The prior art related to economizers and heat exchangers including boilers encompasses a broad spectrum. It includes economizers for providing heated gas for utilization within the burning process of a boiler, as well as heated fluids that are later to be expanded. In other words, the prior art encompasses not only the concept of using the residual or remaining heat after expansion to heat the boiler feed water, but also to heat the air that is to be introduced into the boiler for combustion purposes.

Oftentimes it is customary in boilers, whether they be fire tube boilers, water tube boilers, or any configuration, to take the fluid which has been expanded and later condensed, and heat it from the energy of the exhaust gas that is normally being exhausted. This is accomplished in a number of different ways. However, to date low pressure boiler systems such as fire tube boilers and related types have not incorporated effective heat exchangers. This is due to the fact that oftentimes the heat exchangers provided too much back pressure to such low pressure boilers. They thereby created blockages and the inability of the boiler to function under its normal interior fire wall pressures.

In other words, boilers oftentimes function with an interior pressure of no more than plus point zero 0.05 pressure in inches of water. When the back pressure is increased the walls and other elements of the boiler are not sufficient to withstand such back pressure and the boiler leaks and does not function effectively.

Another problem which has plagued economizer designs and heat recovery heat exchangers, has been the problem related to proper orientation of heat exchanger elements. The size of the heat transfer plates or fins, and tubes, or other materials in which the fluid is carried, has not been optimally sized. In other words, the size of the conduit or heat exchange element in which the fluid or material that is to be carried is not sized with respect to the heat transfer plates or fins.

In the given relationships between a gas transferring heat to a fluid within a conduit having heat exchange plates, the relationship of the conduit and the plates in order to pick up the heat of the gas, should be optimized. This invention enables an establishment of that relationship between the plates and conduit in order to optimize heat transfer between fluids of various types by proper heat or plate relationships and corresponding tube size. This invention optimizes the relationship between the heat transfer elements so that when a fluid passes with respect to another fluid, such as a liquid in a tube having fins or plates passing in relationship to a gas on the outside of the tube, the surface area design of the plates are optimized to enhance the flow of heat between the respective fluids.

In addition to the foregoing features of this invention, this specification teaches improved swaging between a resilient metal tube, such as stainless steel, and a deformable metal plate, such as one of copper or aluminum. When certain resilient metals such as steel are expanded into deformable materials, such as aluminum or copper, the deformation remains. Thus, the tightened swaged relationship between the two metals cannot be maintained. This is particularly serious when contact pressures must be maintained to provide heat transfer.

This invention has overcome the prior art difficulty by enabling a resilient metal, such as the stainless steel tube, to be expanded against a deformable metal, such as the aluminum plates. This is accomplished by having a deformable sleeve receive the resilient tube therein by having it driven or pulled therethrough to deform the sleeve against the plate surrounding the sleeve, thereby allowing a close fit with the resilient tube pressed against the inside diameter of the sleeve and the sleeve pressed against and deformed or swaged against the plate.

In essence, this invention incorporates an enhanced ability to utilize exhaust gases for heating fluid that is to be used as boiler feed water. It provides a superior design of plate to tube relationship to optimize the heat transfer between two fluids. In addition thereto, a superior means for connecting the tubes and the plates is provided for enhanced contact pressure with attendantly improved heat transfer.

SUMMARY OF THE INVENTION

In summation, this invention provides a superior heat exchanger for fire tube and other types of boilers wherein heat is to be transferred from an exhaust gas to a working fluid.

More particularly, the invention incorporates a means to pass exhaust gas through a labyrinth of heat exchange tubes and plates without providing significant back pressure to the boiler. This enables the boiler to function at its normal low pressure range, while at the same time extracting heat from the exhaust gas as it passes over the heat exchange elements. This is accomplished by means of damping and back pressure exhaust control means with an exhaust drawing device, such as a fan or impeller.

Secondly, the invention optimizes the heat transfer element's size and configuration. The optimization includes a reference to the material, taking into consideration the heat transfer coefficients thereof and the fluids, whether they be gas or a liquid, from which the heat is to be extracted and then transferred. This is accomplished by tube and plate or fin designs. The size of the plates that are exposed to one fluid, such as the exhaust gases, are configured to transfer the heat therefrom to the tube in which the liquid is flowing. This is accomplished by sizing the radial flow path of the plates with regard to tube pitch and circumference.

Finally, the invention encompasses the teaching of the utilization of a tube with respect to a plate configuration, wherein the tube is forced into a deformable sleeve which is in turn swaged or expanded into the plate. The tube carrying the fluid is forced against the sleeve, and the sleeve deformed into the plate having openings through which the tube with the sleeve passes and which is normally exposed to the hot exhaust gases. The foregoing maintains high contact pressure to facilitate heat transfer. Stated another way, this is accomplished by means of allowing the resilient tubular elements in which the liquid passes, which are normally made of stainless steel, to be driven into a deformable collar or sleeve around the tube and with the plate openings. In this manner, the resilient material has a bias outward against the deformable collar which maintains its contact around the tube, while at the same time maintaining contact with the deformable plate by the sleeve being swaged thereagainst.

As a consequence, this invention has broad application with regard to three specific portions thereof for heat transfer devices and in particular, with respect to economizers and heat exchangers for boilers.

DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 2:
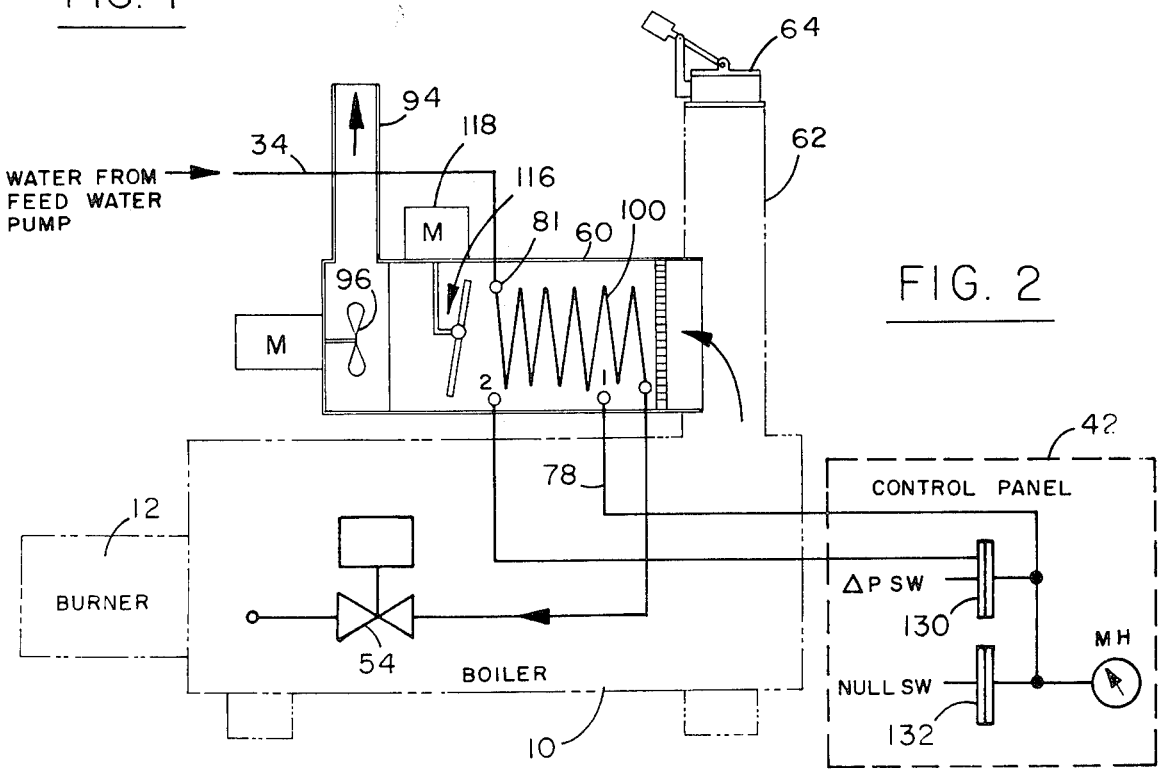
FIG. 2 shows a schematic flow diagram of the elements required for operating this invention.
Figure 4:
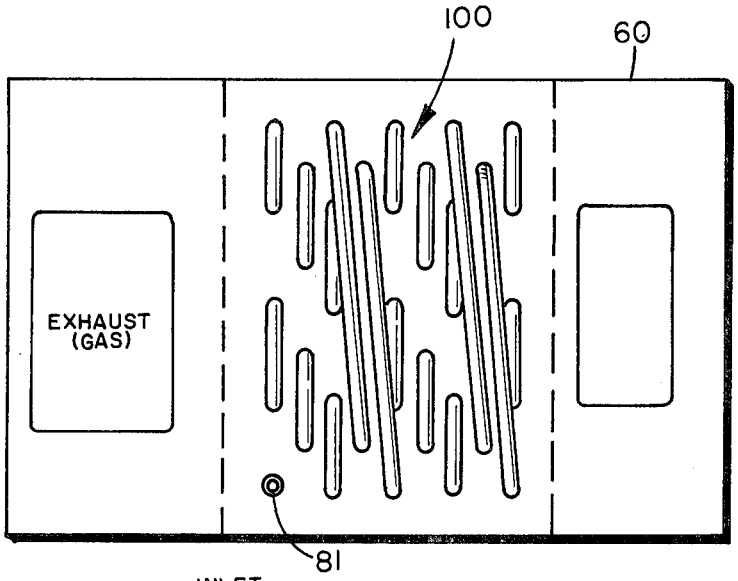
FIG. 4 shows an end view of the tubes passing through the plate of the heat exchanger in the direction of lines 4—4 of FIG. 3.
Figure 3:
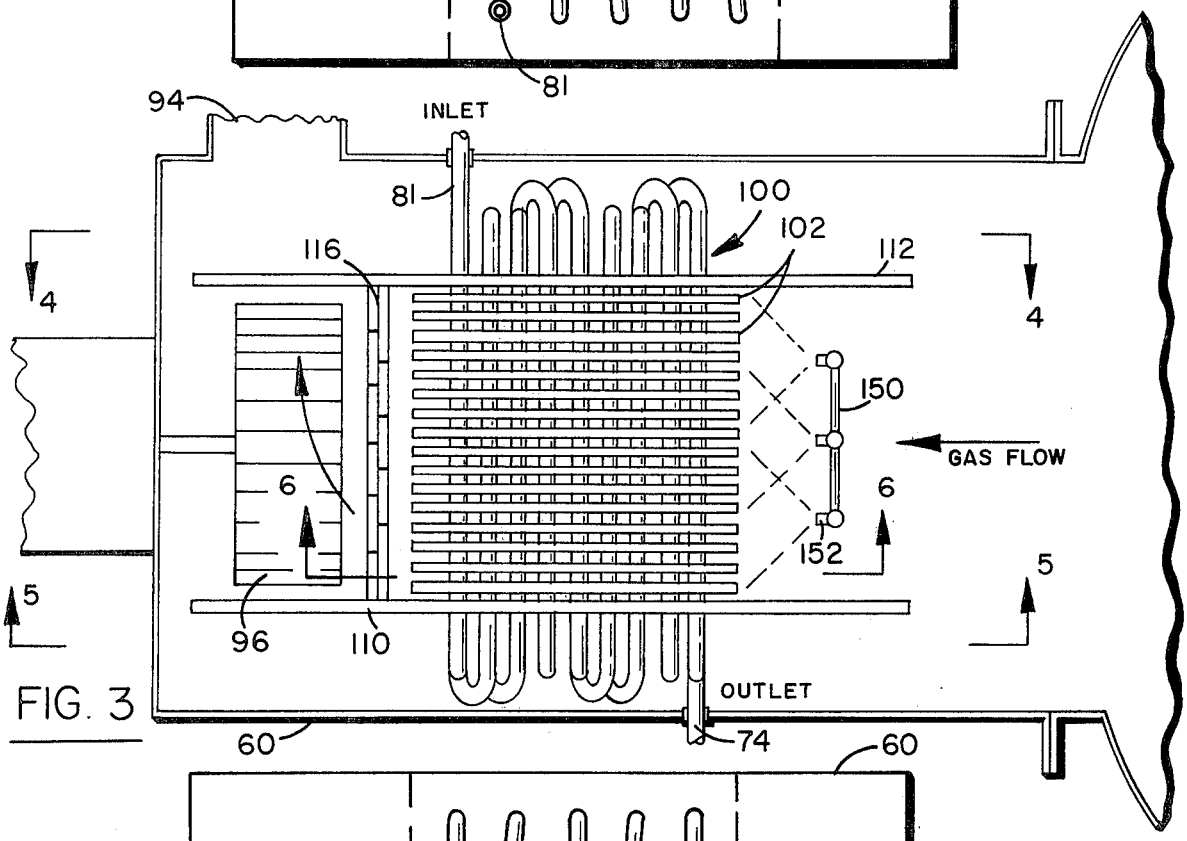
FIG. 3 shows a partially fragmented view looking down on the heat exchange elements of this invention as seen in the direction of lines 3—3 of FIG. 1.
Figure 5:
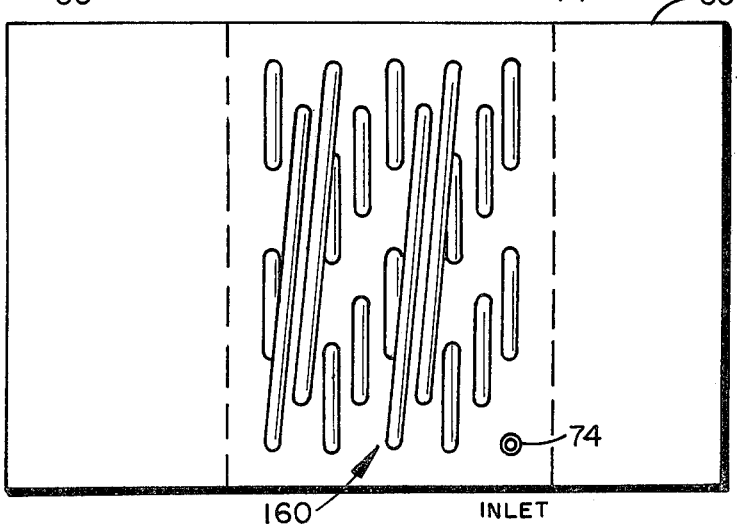
FIG. 5 shows an end view of the tubes passing through the plates of the heat exchanger in the direction of lines 5—5 of FIG. 3.

Looking more particularly at FIG. 2, it can be seen that a boiler 10 is shown having a fire box 12 or burner configuration. The burner configuration is such that it allows for gas or liquid fuel to burn within the fire tubes of the boiler for producing steam in adjacent conduits. The boiler has an outer casing 14 which covers the interior thereof, including the burner and water tubes therein.

It should be understood that other heating or burning apparatus can be utilized for employing this invention. In particular, the invention encompasses an economizer, or heat recovery unit that can function with burners that do not necessarily serve to boil water. The requisite being that the exhaust gases can be used for heating fluid, whether the exhaust gases emanate from a boiler, burner, or other heating device.

Figure 1:
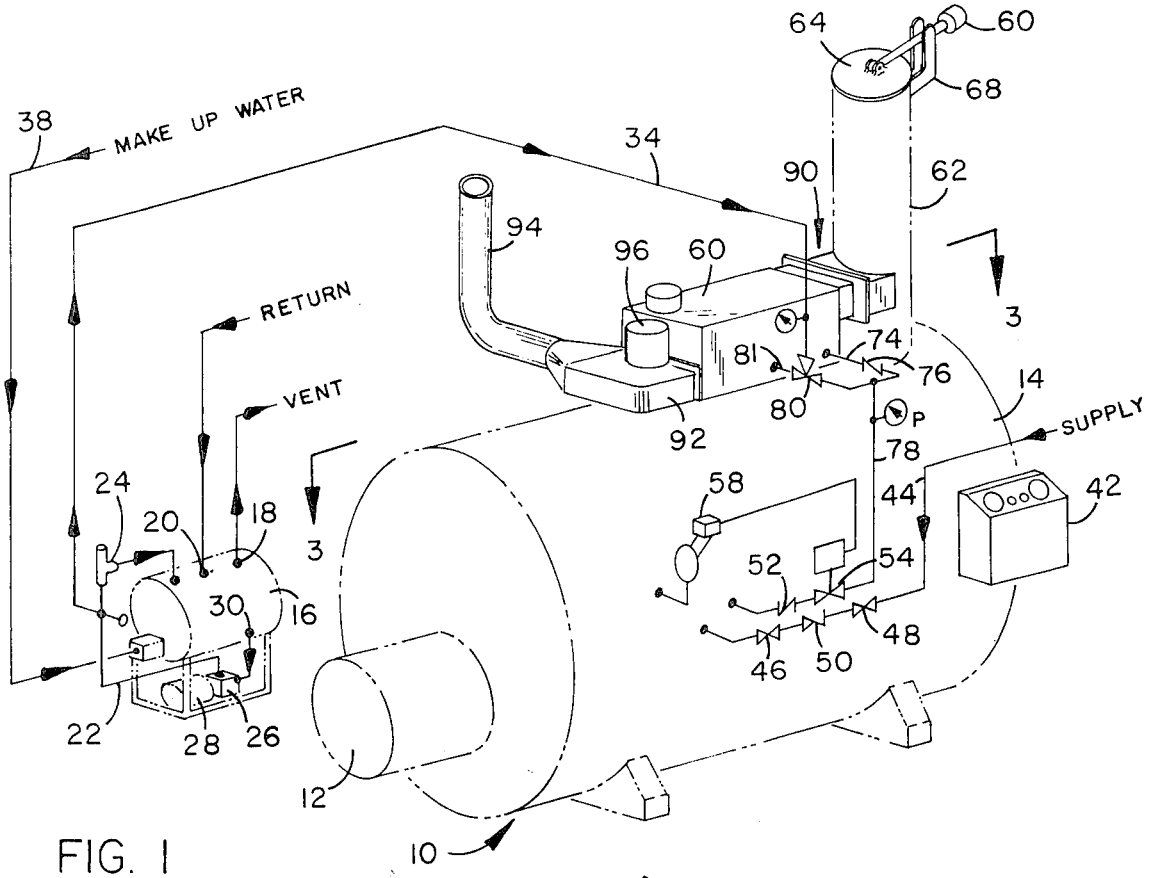
FIG. 1 shows a perspective partially schematic view of the heat exchanger of this invention in cooperation with a boiler.

Looking more particularly at the other exemplary portions of the system in FIG. 1, it can be seen that a sump tank 16 is shown. The sump tank 16 has a vent 18 and a return line 20 from the boiler with an outlet line 22 connected to a bypass valve 24.

Fluid or condensate is delivered from the sump or tank 16 by means of a pump 26 connected to a motor 28. The pump 26 pumps the fluid from an outlet 30 of the sump 16 to the line 22 which is interconnected to a line 34.

Under some conditions, makeup water or fluid is required in the sump, and as a consequence water fed through line 38 can be used in conjunction with the sump tank water 16.

The economizer or heat recovery unit of this invention is controlled from a main control panel 42 that is shown in a schematic form in FIG. 2.

A second source of supply water is shown fed along line 44 into the boiler and controlled by two gate valves 46 and 48 interfaced by a strainer 50 therebetween.

A check valve 52 and a motor operated globe valve 54 interconnects the output of the economizer or heat recovery unit of this invention to the boiler water tubes. The motor operated globe valve 54 is caused to function by means of a motor connected to a level indicator 58 that determines the amount of water in the boiler tubes.

When the heat recovery unit of this invention or economizer is used for other purposes other than a boiler economizer, the controller 58 or float valve level indicator can be substituted by means to monitor other levels or flows of fluid that are to be maintained aside from boiler water.

The economizer or recovery unit of this invention generally comprises a main heat exchanger or gas flow duct 60. The gas flow duct 60 is connected to an exhaust gas stack 62 that normally vents the exhaust gas. The exhaust gas stack 62 has a damper 64 with a counter weight 66 thereon having a pivotal mounting 68. The counter weight 66 controls the opening of the damper 64 so that gas flowing through the stack 62 is at approximately the right pressure to allow for the flow through the duct 60.

The recovery unit or economizer of this invention has a heated fluid outlet portion formed by a conduit or pipe 74. The pipe 74 is connected to a check valve 76 allowing fluid to pass into a line 78 connected to the flow valve 54. A three way valve 80 is interconnected thereto so that the economizer can be either on or off stream, depending upon the desire of the user. In other words, flow through line 34 can be diverted by the valve 80 to the line 78 or through the economizer. This allows for an inactive or passive utilization of the economizer within the system when desired without shutting down any portion of the boiler or burner activities.

The duct 60 which contains the economizer heat exchange elements of this invention is connected to the exhaust gas flue pipe 62 by means of a duct connection 90. An outlet duct 92 is shown connected to a second flue gas outlet 94 for venting or gas passing through the duct 60. The duct 92 has a fan or impeller 96 driven by a motor therein in order to draw gas through the duct 60 or create a negative pressure therein.

The FIG. 2 showing of the schematic represents the boiler 10 with water coming from line 34 through the gate valve to an inlet line 81. The inlet line 81 connected to the three way valve 80 allows for water to flow through a series of pipes or heat exchange elements 100. The pipes 100 are passed back and forth with respect to each other in order to provide for multiple passes through a plurality of plates or fins 102. The relationship between the pipes 100 and the plates 102 will be further defined in this specification. Suffice it to say, they are physically connected in order to provide for optimum heat transfer.

The fan 96 which can be in the form of any impeller allows for gas flow in the direction of the arrows so that it will pass through the duct 60 and to the outlet 94.

The duct 60 encloses a pair of tube support sheets 110 and 112 that are on either end of the plurality of plates 102 and serve to support the entire structure within the duct 60. The pipes 100 are formed as one continuous pipe with numerous convolutions passing through the plates 102 in the form of U-shaped members turned back on each other.

A damper 116, having a motor control 118 connected thereto, allows for various rates of flow through the duct 60. The damper 116 and its support is specifically oriented for purposes of controlling the differential pressure to allow for constant flow through the duct 60 over the tubes 100.

The control panel 42 has an electrical connection to a first and second point in the duct 60 in order to detect the differential pressure between those points. These points 1 and 2 represent the general pressure drop across the tubes 100 and plates 102 so that the fan 96 in cooperation with the damper can control the gas flow rate. The differential pressure setting is provided so that the damper 116 can open or close in response to the motor orientation directed by the differential pressure switch.

In other words, a differential pressure switch 130 connected to points one and two in the duct 60 detects the relative pressure changes, so that the differential pressure switch 130 can detect the pressures and establish a proper angle of the damper 116 for adequate flow and attendant heat exchange. This is accomplished by means of driving the motor 118 in response to a pre-set differential pressure that can be pre-set on the control panel or be established automatically. The object of the foregoing is to regulate the passage of flue gases in duct 60.

In addition thereto, a null switch 132 is utilized for detecting the lack of gas flow and allowing for overall control and balance of the system. The null switch is electrically oriented for providing a negative pressure within the boiler by the exhaust fan 96 drawing down a negative pressure on the boiler. Thus, the boiler operates at negative pressure for improved burning and gas flow.

The fan 96 is one of the key elements of this invention because it provides the induced flow necessary to draw the flue or exhaust gases through the labyrinth of the plates 102 and tubes 100. Without this, the restriction of the plates and tubes, particularly in a fire tube boiler, would provide essential restrictions to the extent where the fire tube boiler would not operate efficiently of effectively. A fire tube boiler cannot stand much positive pressure therein. Usually fire tube boilers operate in the range of plus 0.05 inches of water pressure which is substantially increased in the eventuality a restriction is placed in the exhaust, whether it be in the lines or the exhaust duct 62. Consequently, a drawing of gas by the fan 96 is essential in order to prevent the plates 102 from unduly restricting flow to the extent where gas flow is not maintained and the fire box or the burner 12 cannot pass gases sufficiently through the boiler.

In effect, enhanced operation is accomplished by this invention due to the fact that the negative pressure provided by the fan or impeller 96 allows for improved boiler efficiency so that the gases and other products of combustion move more effectively through the fire tubes of the boiler.

In order to clean the tubes 100 and the plates 102, a soot blower 150 is provided having a number of jets 152 that spray water or steam in the direction of the plates 102 for discharging any soot thereon. This improves the efficiency of the plates and the heat transfer thereof to prevent buildup of soot beyond an intolerable level.

A particular unique feature of this invention resides within the relationship of the tubes 100 and the plates 102, as well as the physical connection between the two.

The physical connection between the plates 102 and the tubes 100 is enhanced by a collar 160 or insert. The collar 160 in this case is made from a deformable metal, similar to the soft or deformable metal of the plates 102. The reason for inserting the tubes 100 within the collar 160 as they pass through the openings of the plates 102 is fundamentally a problem of contact pressure.

It has been found that increased contact pressure between the tubes 100 and the plates 102 enhances the heat transfer significantly between them. In the past when such hardened resilient materials as stainless steel tubes 100 are implaced in deformable metal, such as copper and aluminum plates 102, the heat transfer has been casual at best. In other words, when the tubes 100 are implaced, swaged, or expanded within the openings of plates 102, the openings of the plates expand, while the tubes 100 retract after expansion due to their resilient nature, and thereby create a loose fit. This invention provides a forcing or driving of the tubes 100 against the collars 160 or insert, so that the resilient tubes have the collars therearound in close contact, placing them in intimate contact with the plates. The forcing of the tubes into the collars expands the collars due to their deformable nature in swaged contact against the deformable plates, while at the same time placing the collar in a shrink fit type of relationship with the tubes 100. This thereby allows for increased contact pressure with attendant increase in heat transfer.

Figure 8:
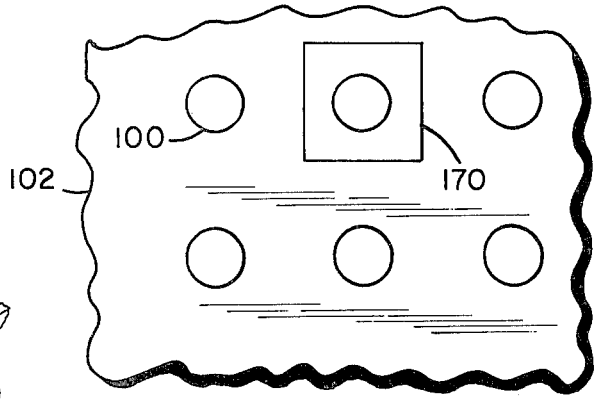
Figure 7:
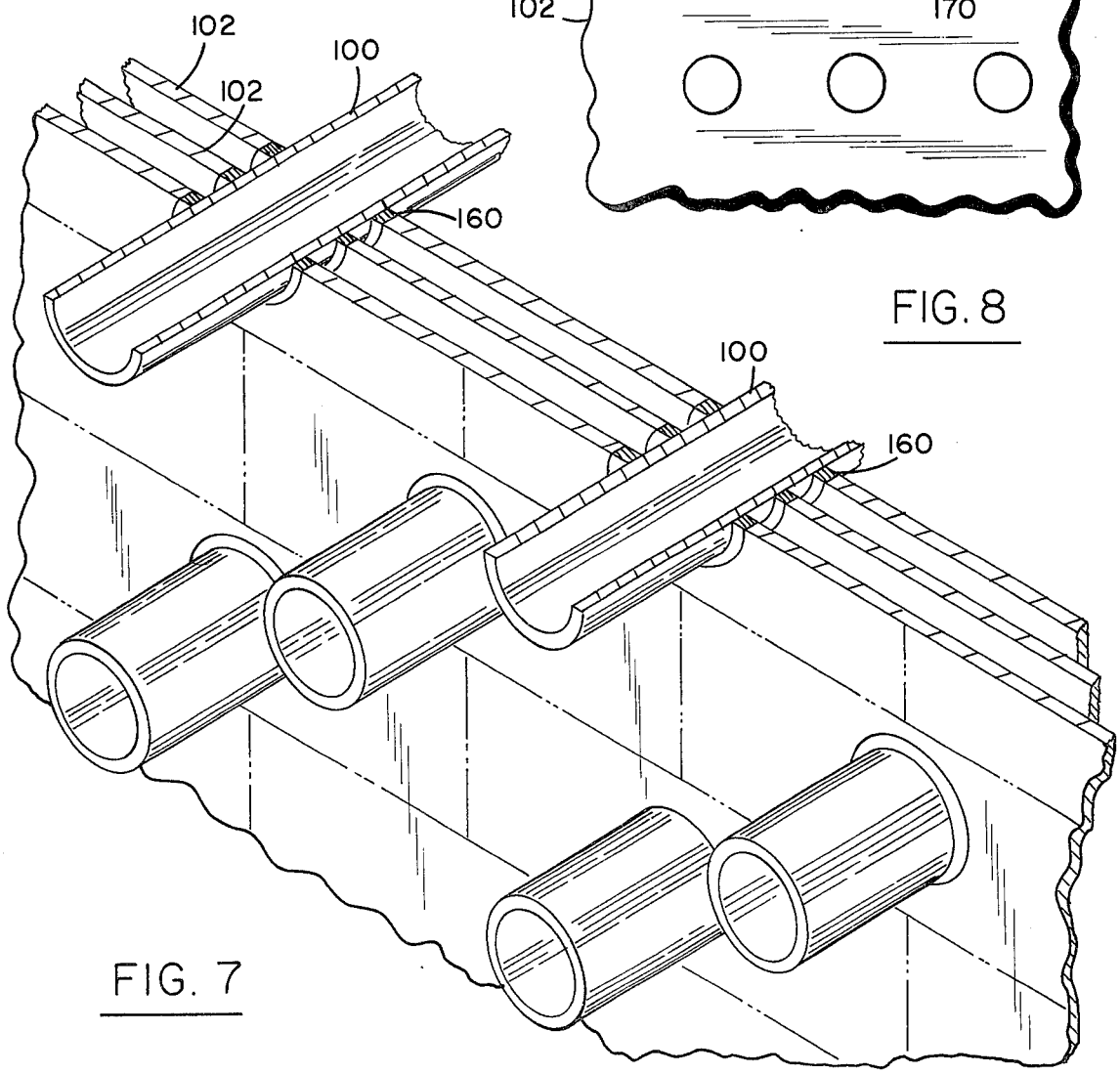
FIG. 7 shows a perspective view of the tubes of this invention in their relationship to the fins or plates through which they pass; and, FIG. 8 shows a fragmented view of a plate and tube arrangement, not of this invention.

A particularly notable key element of this invention is the optimization of the placement of the plates 102 in their relationship to the tubes 100. It has been found that the inline normal pitch of tubes as shown in FIG. 8 does not optimize heat transfer due to the fact that there are large areas surrounding the tubes such as area 170 that are wasted as far as heat transfer from the plate 102 to the tube 100 to a significant degree.

Figure 6:
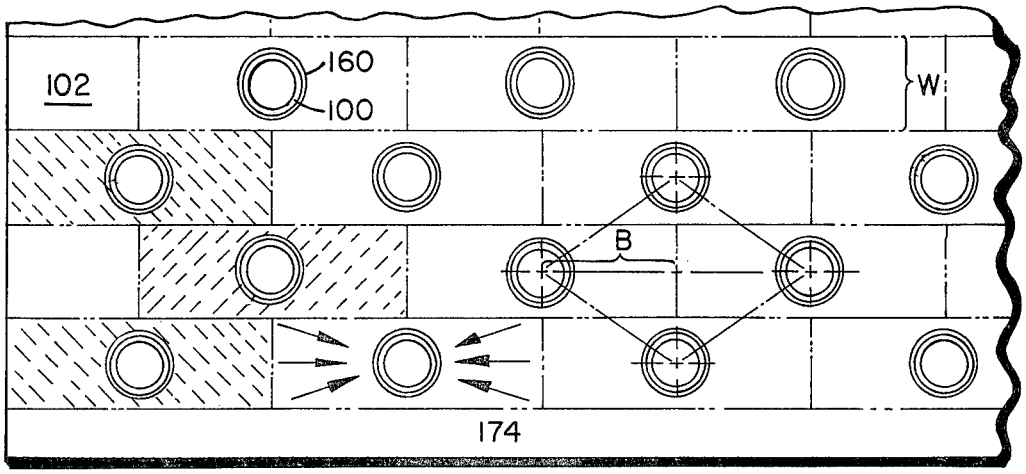
FIG. 6 shows a detailed view of the tube placement and pitch passing through the plate in a fragmented section thereof in the direction of lines 6—6 of FIG. 3.

Looking more particularly at the showing of FIG. 6, it can be seen that there is an offset pitch relationship between the tubes 100 which are all equally spaced. The offset pitch allows for optimum heat flow to the tubes, as can be seen in the inset 174. The arrows of inset 174 are representative of heat transfer lines passing in a direction from the boundary areas of the plates to the tubes 100. In particular, the inset 174 is representative of an element or segment of the plates 102 that receive heat for transfer to the tubes 160.

In optimizing the pitch between tubes 160 by this invention, it has been found that the dimension W of the lateral pitch between tubes should be equal to or less than one half the circumference of the tube.

In order to provide for the longitudinal pitch or difference between the tubes' axis in the other direction, the distance B therebetween should be defined by the following equations. In particular, B is the fin or height distance extracted from the formula M times B (M × B). The lower the value of M × B, the greater the efficiency of the heat transfer.

M is derived by the formula $M = ([2(H)]/[K(T)])^{1/2}$.

The foregoing equation is such that it provides $M$ in units of feet to obtain the efficiency of the fin and tube relationship.

In the foregoing formula, $H$ is in BTU's per hour, per foot square in degrees of fahrenheit which is characteristic of the movement of the fluid and type of fluid. It is fundamentally concerned with the heat transfer through the fins or plates. $K$ is the thermal conductivity in BTU's per hour per foot squared per foot, which is the fundamental coefficient of heat transfer of the material and $T$ is the thickness of the fin in feet.

Thus M × B gives the formula for efficiency wherein B is the length or the spacing that is to be prescribed between the tube centers in their longitudinal relationship to provide optimum conductivity, In effect, the lower the numerical value of M × B, the greater the efficiency.

The foregoing establishes an optimum relationship between the fins 102 and the tubes 100 in gas to liquid transfer. To maintain optimum fin and tube design, the ranges should be substantially kept in the foregoing ranges.

From the foregoing, it can be seen that this invention incorporates a new heat exchanger or economizer unit with a negative pressure system for use in fire tube boilers, and incorporates a unique tube placement relationship for optimization of heat transfer between the tube and the heat transfer plates, as well as facilitating increased contact pressure between the tubes and the plates. Consequently, this invention should be construed broadly in light of the advances hereof and the claims read to the full scope and spirit thereof over the prior art.

I claim:

1. A heat exchanger for exchanging heat between a gas and a liquid wherein the improvement comprises:

a duct for conducting hot exhaust gases from a prior combustion process;

a plurality of interconnected tubes provided with an inlet and an outlet and passing through said duct to receive heat from the exhaust gases;

means to connect said tubes at the inlet and outlet thereof to a fluid that is to be heated therein;

a plurality of plates in contact with the respective tubes implaced in said duct for receiving heat from the exhaust gases passing thereover;

fan means connected to said duct to draw exhaust gases in the direction of said fan means across the plates and tubes, thereby diminishing the restriction of gas flow caused by said plates and tubes;

a damper within said duct for regulating the flow of gases through said duct over said plates and tubes of the heat exchanger; and, means to control said damper comprising at least in part a differential pressure detector for detecting differences in pressure between the upstream and downstream points within said duct for accordingly adjusting the position of said damper.

2. The improvement as claimed in claim 1 further comprising:

gas drawing means in the form of a fan; and, a damper within said duct for regulating the amount of flow of gases through said duct over said plates and tubes of the heat exchanger.

3. The improvement as claimed in claim 1 wherein:

said duct is connected to an outlet flue of a boiler.

4. The improvement as claimed in claim 3 wherein:

said boiler is a fire tube boiler.

5. The improvement as claimed in claim 1 further comprising:

a soot blower placed in adjacent relationship to said plates and connected to a source of water for blowing soot off of said plates by water under pressure.

6. The improvement as claimed in claim 1 wherein:

said tubes comprise a continuous tube connected to an inlet of water from at least a partial condensate source; and, said outlet of said tubes is connected to said boiler.

7. The improvement as claimed in claim 1 wherein said damper control means further comprises:

a motor to control said damper that is in turn at least partially controlled by said differential pressure detector.

8. The improvement as claimed in claim 1 wherein:

said tubes are implaced within said plates With a deformable metal collar surrounding each one of said tubes where they pass through said plates in surrounding relationship to said tubes.

9. The improvement as claimed in claim 8 wherein:

said plates are formed from aluminum;

said collars are formed from aluminum; and, said tubes are formed from steel.

10. The improvement as claimed in claim 1 wherein:

said plates and said tubes are such that the longitudinal pitch B between tubes along the length of the plates is defined by the equation M × B in a manner so that the lower value of M × B, the greater the efficiency, and wherein $M = ([2\ (H)]/[K\ (T)])^{1/2}$ where $H$ is in BTU's per hour per foot squared in degrees fahrenheit, $K$ is the thermal conductivity in BTU's per hour per foot squared per foot, $T$ is the thickness of the fin in feet; and, wherein said lateral pitch between the tubes is defined by the term W which should be less than, or equal to one half the circumference of the tubes.

11. An improved heat transfer device for heating a fluid comprising:

a plurality of tubes for receiving a fluid which is to be heated therein;

a plurality of plates adapted for exposure to hot gases and surrounding the respective tubes for transferring heat conducted to said plates to said tubes in a manner wherein said tubes are respectively pitched in longitudinal and lateral relationship with each other substantially within the following formula ranges:

said longitudinal pitch being B as derived from the formula M × B which is to be a minimum value and wherein M is derived from the formula $M = ([2\ (H)]/[K\ (T)])^{1/2}$ where $H$ is in BTU's per hour per foot squared in degrees fahrenheit, $K$ is the thermal conductivity in BTU's per hour per foot squared, $T$ is the thickness of the fin in feet; and, wherein said lateral pitch between the tubes is defined by the term W which should be less than or equal to one half the circumference of the tubes.

12. The improvement as claimed in claim 11 wherein:

a duct surrounds said plates and said tubes; and, said duct is connected to a fan for providing a negative pressure for drawing the gases across said plate and said tubes in said duct.

* * * * *